US006390382B1

(12) United States Patent
Hodgson et al.

(10) Patent No.: US 6,390,382 B1
(45) Date of Patent: May 21, 2002

(54) RAIL FIXINGS

(75) Inventors: William Hodgson, Cumbria; John Barry Clarke, Rotherham; David Farrington, Cumbria; David John Thompson, Southampton; Christopher John Cedric Jones, Romsey, all of (GB)

(73) Assignees: Corus UK Limited; University of Southampton, both of (GB)

( * ) Notice: Subject to any disclaimer, the term of this patent is extended or adjusted under 35 U.S.C. 154(b) by 0 days.

(21) Appl. No.: 09/508,101

(22) PCT Filed: Sep. 18, 1998

(86) PCT No.: PCT/GB98/02767

§ 371 Date: Sep. 6, 2000

§ 102(e) Date: Sep. 6, 2000

(87) PCT Pub. No.: WO99/15732

PCT Pub. Date: Apr. 1, 1999

(30) Foreign Application Priority Data

Sep. 19, 1997 (GB) ..... 9719864

(51) Int. Cl.[7] ..... E01B 19/00
(52) U.S. Cl. ..... 238/382; 238/283; 105/452
(58) Field of Search ..... 238/382, 283, 238/275, 276, 292, 293, 306, 307, 336; 105/452

(56) References Cited

U.S. PATENT DOCUMENTS 1,771,079 A * 7/1930 Fischer ..... 238/382
3,383,043 A * 5/1968 Tew ..... 238/283
4,203,546 A * 5/1980 Raquet et al. ..... 238/1
4,355,578 A 10/1982 Raquet ..... 104/1 A
4,364,594 A 12/1982 Raquet ..... 295/7
4,775,103 A * 10/1988 Ortwein ..... 238/283

FOREIGN PATENT DOCUMENTS

| | | | |
|---|---|---|---|
| DE | 3631492 | 3/1988 | ..... E01B/19/00 |
| EP | 0628660 | 12/1994 | ..... E01B/19/00 |
| EP | 0761879 | 12/1997 | ..... E01B/19/00 |

* cited by examiner

*Primary Examiner*—S. Joseph Morano
*Assistant Examiner*—Louis A. Olson
(74) *Attorney, Agent, or Firm*—Blank Rome LLP

(57) ABSTRACT

A damper for reducing the track nose emitted by a rail system comprises a deformable material attachable to a surface of the rail, incorporating a plurality of elongate discontinuous resonant members of a stiff material as compared to the deformable material, sized to contain at least two resonant frequencies in the range of interest. The resonant members are suitably of steel or other metallic material. They can be of different profile, to form a resonant system with at least two resonant frequencies in the relevant frequency range. They are suitably embedded in the deformable material, to ensure adequate vibrational transfer from the rail to the resonant members and also provide environmental protection. The deformable member is visco-elastic, for example rubber or rubber-like material. This may be preformed and glued to the rail, or it can be cured in place on the rail. The damper is positioned on the rail at the junction between the web and the foot of the rail. One resonant member can be an elongate angled section, the angle preferably matching the angle between external surfaces of the head and foot. Another resonant member can be a solid elongate block, the external faces adjacent the web and foot being angled to match.

20 Claims, 2 Drawing Sheets

RAIL FIXINGS

BACKGROUND OF THE INVENTION

FIELD OF THE INVENTION

Figure 1:
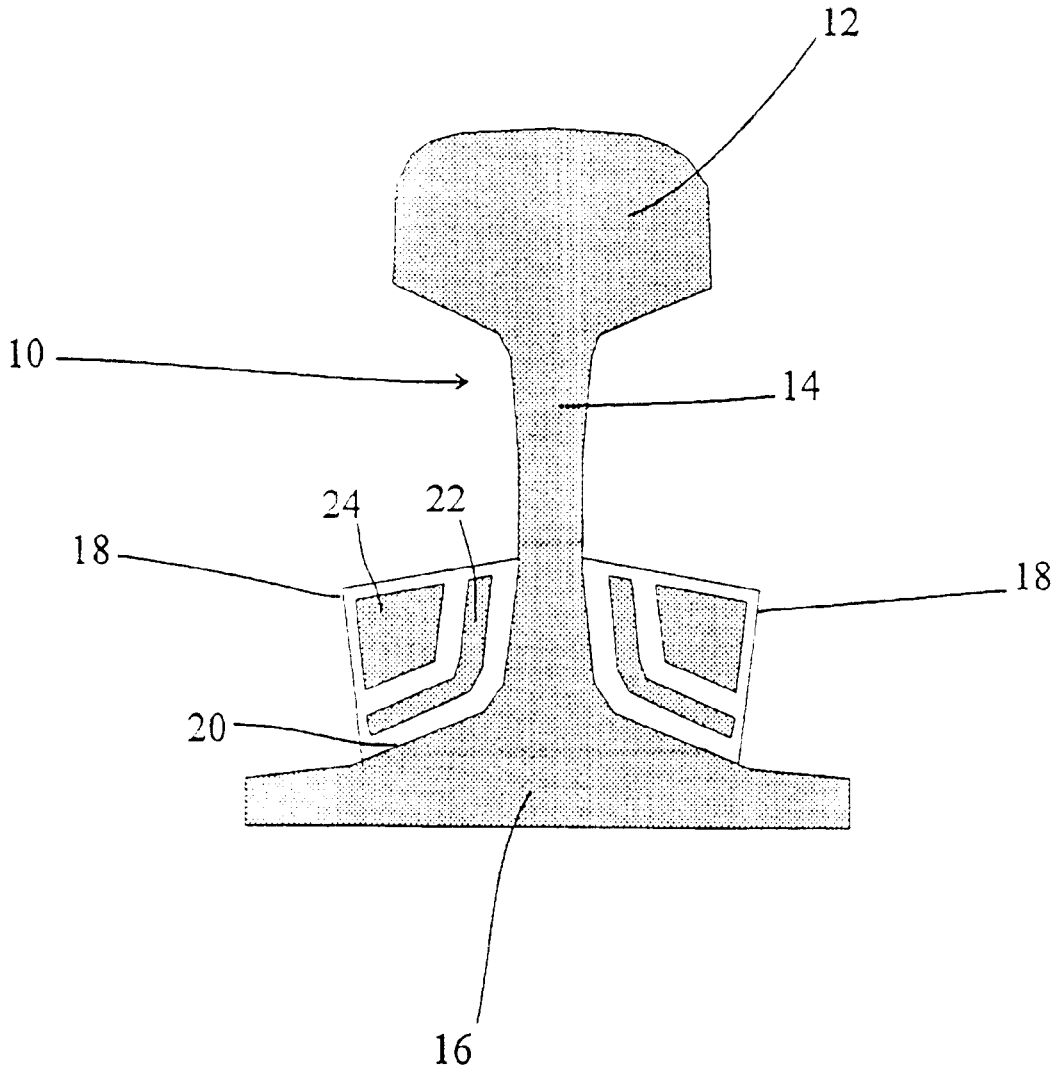

The present invention relates to rail fixings. It is more particularly concerned with rail fixings that exhibit advantageous noise characteristics.

The noise emitted by moving rail vehicles is a major limitation on their use, in that it will limit the ability of operators to install new lines in populated areas, and will limit speeds and traffic volumes on existing lines. The noise tends to be dominated by rolling noise from the wheel/rail interface, which is caused partly by vibration of the wheels and partly by vibration of the track.

It is not possible to select alternative materials, etc, for these elements since they are subject to very high transient loads during use, and must withstand these. Materials which would be able to absorb vibration and hence reduce noise would be unable to survive in use for any appreciable time. Resilient rail fastenings have been employed to reduce track forces and thereby reduce component damage and structure-borne noise. However, they have an adverse effect on track noise as they tend to reduce the attenuation of rail vibration.

SUMMARY OF THE INVENTION

The present invention seeks to provide a means for reducing the track noise emitted by a rail system. It therefore provides a damper for a rail, comprising at least one deformable material attachable to a surface of the rail and incorporating a plurality of elongate resonant members, the resonant members being of a stiff material as compared to the deformable material and being sized to form a resonant system with at least two resonances in the frequency range where rail vibration is to be reduced.

It is preferred if the resonant members are of different profile, as this provides an easy way of tuning to two different frequencies. However, this can still be achieved with identical profiles. They are suitably embedded in the deformable material, as this both ensures adequate vibrational transfer from the rail to the resonant members and also provides environmental protection. They are ideally more dense than the resilient material. They are suitably of steel or other dense material.

The deformable member is preferably visco-elastic, for example rubber or a rubber-like material. This may be preformed and glued to the rail, or it can be cured in place on the rail.

It is strongly preferred that the damper is positioned on the rail so as to cover the junction between the web and the foot of the rail. This has been found to be exceptionally advantageous in terms of the amount of damping needed to achieve adequate noise reduction. At this position, a damper with at least two resonant frequencies according to the invention can reduce significantly the noise level of the rail. One resonant member can be a elongate angled section, the angle preferably matching the angle between external surfaces of the head and foot. Another resonant member can be a solid elongate block, the external faces adjacent the web and foot being angled to match. Further resonant members can be employed as necessary.

The damper will be easier to manufacture and easier to apply to existing rail if the resonant members are discontinuous within the deformable material. Ideally, the discontinuities in the plurality of resonant members will coincide.

It is also possible to apply the damper in discrete sections, leaving gaps (for example) for rail fasteners. However, a continuous length of damper is preferred.

It is preferable for there to be a pair of such dampers, one either side of the rail.

An embodiment of the present invention will now be described, by way of example, with reference to the accompanying Figures;

BRIEF DESCRIPTION OF THE FIGURES OF DRAWINGS

Figure 2:
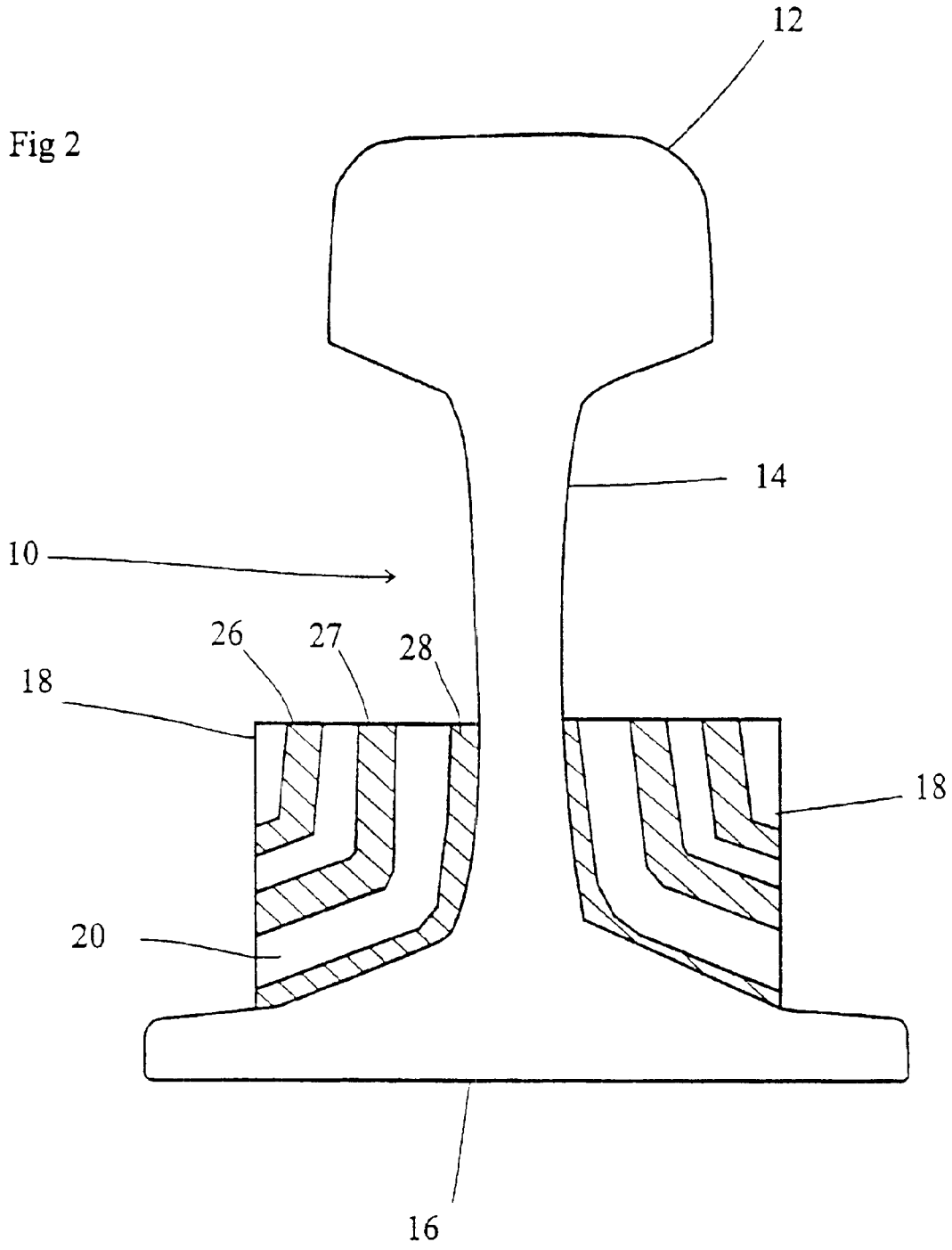

FIG. 1 is a vertical section through a rail incorporating dampers being a first embodiment; and FIG. 2 is a vertical section through a rail incorporating dampers being a second embodiment.

DETAILED DESCRIPTION OF THE PREFERRED EMBODIMENT

FIG. 1 shows a vertical section through a rail 10 fitted with a damper according to the present invention. The rail 10 comprises a head 12 which carries the traffic and a narrower web 14 extending downwardly from the head 12 to a foot 16, generally wider than both the head 12 and web 14, on which the rail section rests. In this respect it is a standard rail section.

The junction between the web 14 and the foot 16 is smoothed for fatigue reasons (amongst others), but is essentially a transition from a substantially vertical face to a gently downward sloping top surface of the foot 16. Thus, the angle is somewhat over 90° , usually in the region of 120° .

In this junction, a pair of dampers 18 are provided. One damper 18 is attached on either side. As illustrated, the dampers are identical, which is preferred. Each damper comprises a block of rubber 20 in which is embedded a first resonant member 22 and a second resonant member 24. The first resonant member is an elongate angled member, the angle corresponding to the junction between the head and foot. The second resonant member is an elongate solid section, positioned in the angle of the first and with two faces at a corresponding angle. The mass per unit length of the first member is greater than the others, significantly so.

Although not visible in FIG. 1, the resonant members are discontinuous to allow the damper section to be cut. This eases application of the damper to rail. A suitable maximum length for the sections is 1 metre for application to existing rail.

The top surface of the damper 18 can be profiled to prevent water from building up and seeping into the system.

This arrangement of dampers provides a particularly compact arrangement which is nevertheless able to absorb a wide band of frequencies efficiently from the rail. This frequency band, which may be different for vertical and lateral vibration of the rail, is determined by the resonances of the damper. These resonances are controlled by the choice of mass per unit length of the resonant members and by the surrounding geometry and the physical properties (principally the stiffness) of the material between the resonant members. The width of the frequency band is also determined by the damping properties of the visco-elastic material in the interlayers. The visco-elastic provides a support medium for the resonant members and by its damping properties dissipates vibrational energy. It may be preferable to use different materials for the different interlayers instead of or as well as different thicknesses to obtain the required stiffnesses and thereby affect the resonance frequencies. Positioning the damper at the junction between the web and foot is particularly efficient for absorption, and also avoids interference with passing wheels, track maintenance operations and rail clips. It is also easily accessible for fitting dampers to existing lengths of rail. The compactness of the damper is significant in minimising the noise radiation from the damper itself.

FIG. 2 shows a second embodiment of the present invention. Most features of the second embodiment are identical to the first and have therefore been indicated using identical reference numerals. The second embodiment differs only in the construction of the dampers.

According to the second embodiment, first, second and third resonant members 26, 27 and 28 (respectively) are provided. All three in this embodiment consist of an angled metallic member. Each are of different external dimensions so as to resonate at different frequencies. The three are nestled within each other and within the rubber block 20.

The dampers of the present invention could be applied in conjunction with known resilient rail fasteners. This would enable the other advantages of resilient fasteners to be achieved without an unacceptable increase in noise.

Other variations could be made to the embodiments without departing from the scope of the present invention. For example, the resonant members could be arrange end-to-end instead of adjacent as illustrated. They would then be in the same mass of deformable material or in adjacent masses.

What is claimed is:

1. A damper for a rail comprising a section of deformable material defining a face attachable to a surface of the rail, the damper incorporating a plurality of elongate resonant members within the deformable material so as to be separated from the attachment face, the resonant members being of a stiff material as compared to the deformable material and being sized to exhibit at least two resonant frequencies in the range of vibration frequencies of the rail.

2. A damper according to claim 1 wherein the resonant members are of a more dense material than the deformable material.

3. A damper according to claim 1 wherein the resonant members are of steel or other metallic material.

4. A damper according to claim 1 wherein the resonant members are of different profile.

5. A damper according to claim 1 wherein the resonant members are embedded in the deformable material.

6. A damper according to claim 1 wherein the deformable member is visco-elastic.

7. A damper according to claim 1 wherein the deformable member is rubber or rubber-like.

8. A damper according to claim 1 wherein the deformable material is substantially uniform in composition.

9. A damper according to claim 1 in which the resonant members are discontinuous within the deformable material.

10. A damper according to claim 9 in which the discontinuities in the plurality of resonant members coincide.

11. A rail to which is attached a damper according to claim 1.

12. A rail according to claim 11, the damper being preformed and glued to the rail.

13. A rail according to claim 11, the damper being cured in place on the rail.

14. A rail according to claim 11, the damper being positioned on the rail so as to cover the junction between the web and the foot of the rail.

15. A rail according to claim 11 in which at least one resonant member is an elongate angled section.

16. A rail according to claim 15 in which the angle matches the angle between external surfaces of the head and foot.

17. A rail according to claim 11 in which one of the resonant members of the damper is a solid elongate block.

18. A rail to which a damper according to claim 1 is attached on both sides thereof.

19. A damper according to claim 1 in which at least one resonant member is a elongate angled section.

20. A damper according to claim 1 in which one of the resonant members is a solid elongate block.

* * * * *